US005456849A

United States Patent [19]

Houghton et al.

[11] Patent Number: 5,456,849

[45] Date of Patent: Oct. 10, 1995

[54] NON-AQUEOUS LIQUID DETERGENTS CONTAINING A DISPERSED SOLID MATERIAL WITH TWO DIFFERENT SIZE FRACTIONS

[75] Inventors: Mark P. Houghton, Rotterdam; Charles C. Verburg, Vlaardingen, both of Netherlands

[73] Assignee: Lever Brothers Company, Division of Conopco, Inc., New York, N.Y.

[21] Appl. No.: 272,440

[22] Filed: Jul. 8, 1994

Related U.S. Application Data

[63] Continuation of Ser. No. 968,102, Oct. 29, 1992, abandoned.

[30] Foreign Application Priority Data

Nov. 1, 1991 [GB] United Kingdom ..... 9123219

[51] Int. Cl.[6] ..... C11D 1/72; C11D 3/395; C11D 3/43; C11D 17/08

[52] U.S. Cl. ..... 252/95; 252/99; 252/104; 252/140; 252/164; 252/165; 252/174.21; 252/174.25; 252/DIG. 14

[58] Field of Search ..... 252/99, 104, 140, 252/164, 165, 174.21, 174.25, DIG. 14, 95

[56] References Cited

U.S. PATENT DOCUMENTS

| | | | |
|---|---|---|---|
| 3,169,930 | 2/1955 | Gedge | 252/527 |
| 4,690,771 | 9/1987 | Ouhadi | 252/102 |
| 4,929,380 | 5/1990 | Schulz et al. | 252/121 |
| 4,931,195 | 6/1990 | Cao | 252/8.8 |
| 5,147,576 | 9/1992 | Montague | 252/174 |

FOREIGN PATENT DOCUMENTS

| | | |
|---|---|---|
| 30096 | 6/1981 | European Pat. Off. . |
| 266199 | 5/1988 | European Pat. Off. . |
| 444858 | 9/1991 | European Pat. Off. . |
| 1205711 | 9/1970 | United Kingdom . |
| 1270040 | 4/1972 | United Kingdom . |
| 2208232 | 3/1989 | United Kingdom . |
| 2237285 | 5/1991 | United Kingdom . |

OTHER PUBLICATIONS

European Search Report & Annex.

*Primary Examiner*—Dennis Albrecht
*Attorney, Agent, or Firm*—Ronald A. Koatz

[57] ABSTRACT

A substantially non-aqueous liquid cleaning product composition comprises from 10 to 90% by weight of a non-aqueous organic solvent, from 0.01 to 15% by weight of a deflocculant and from 30 to 90% by weight of particles of solid material dispersed in the solvent, wherein from 25 to 75% by weight of the solid material has a D(3,2) average particle diameter of less than 10 μm and from 75 to 25% by weight of the solid material has a D(3,2) average particle diameter of more than 10 μm, and the D(3,2) average particle size of the solid material is more than 10 μm.

2 Claims, 1 Drawing Sheet

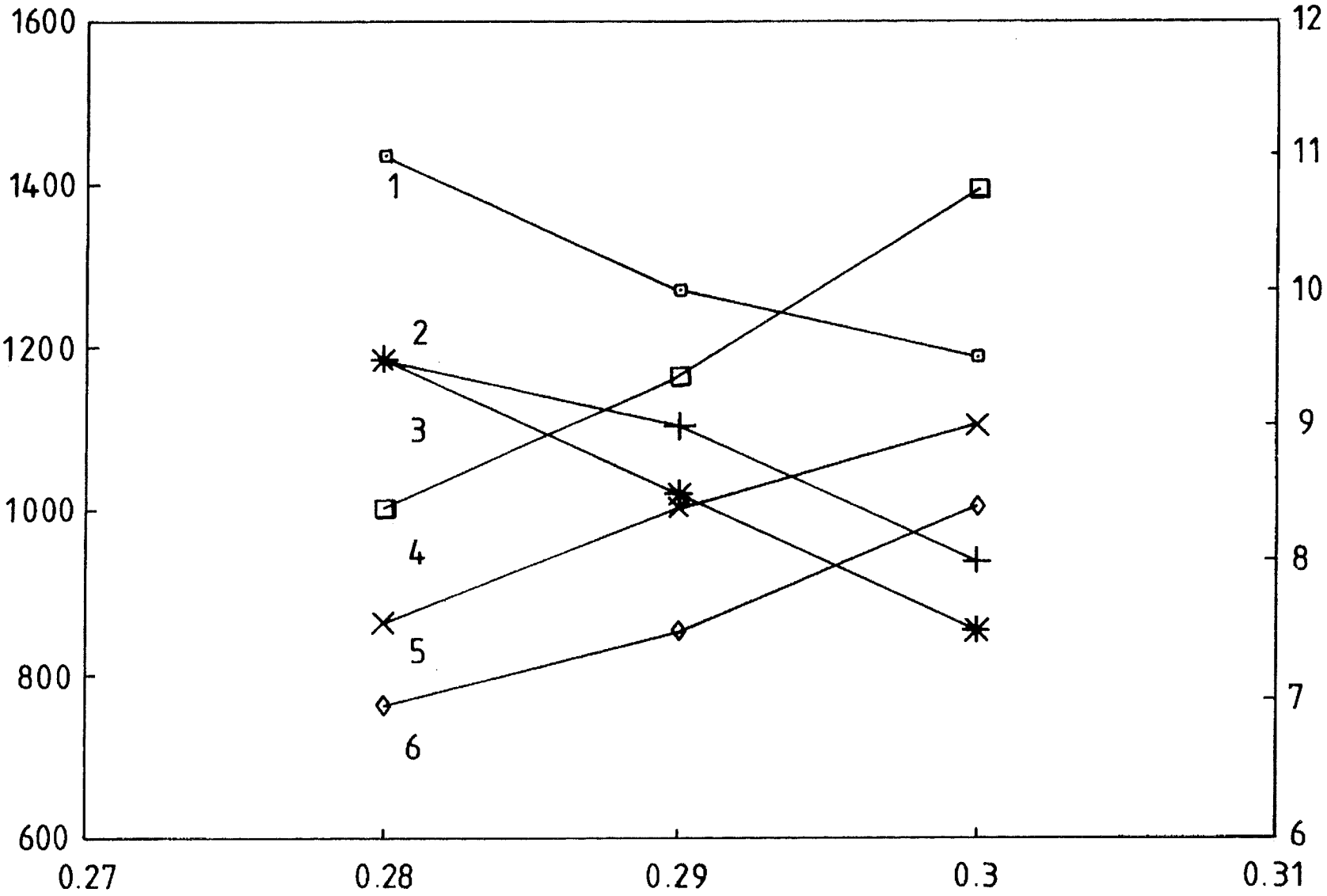
1600
1400
1200
1000
800
600
12
11
10
9
8
7
6
0.27
0.28
0.29
0.3
0.31
1
2
3
4
5
6

NON-AQUEOUS LIQUID DETERGENTS CONTAINING A DISPERSED SOLID MATERIAL WITH TWO DIFFERENT SIZE FRACTIONS

This is a continuation application of Ser. No. 07/968,102, filed Oct. 29, 1992, now abandoned.

The present invention relates to substantially non-aqueous liquid cleaning products, especially although not exclusively, to non-aqueous liquid detergent compositions containing particulate solid materials dispersed in a non-aqueous liquid phase. Non-aqueous liquids are those containing little or no water.

In liquid detergents in general, especially those for the washing of fabrics, it is often desired to disperse or suspend particulate solids which have beneficial auxiliary effects in the wash, for example detergency builders to counteract water hardness, as well as bleaches.

European Patent Specification EP-A-30 096 describes non-aqueous liquid detergent compositions comprising a dispersion of solids in a water-free nonionic surfactant. For providing an effective dispersion of the solids in the liquid phase it is required that the average particle diameter of the solids is less than 10 micrometers.

U.S. Pat. No. 3 169 930 describes how builder particles with a particle size of about 25 to 30 microns can be stably dispersed in a liquid nonionic surfactant by including builder particles smaller than 10 microns, e.g. down to 0.015 microns. The stabilisation mechanism appears to be that the smaller particles create a loosely associated network which inhibits sedimentation of the larger particles. This is analogous to adding very small silica particles such as described in the specifications of U.K. Patents GB 1 205 711 and GB 1 270 040.

EP-A-266 199 describes use of a deflocculant for preventing particle coagulation and solidification of non-aqueous dispersions. The latter specification defines a specific test to determine whether a substance will be a deflocculant in a given system. In principle, a deflocculant may be any material disclosed in the latter specification or any other, provided it fulfils the aforementioned test.

Deflocculants are believed to neutralise effectively the interaction between particles which would otherwise result in network formation. Therefore, persons skilled in the art would expect that any stabilisation against sedimentation due to the presence of particles having sizes below 10 μm would be negated by the presence of a deflocculant.

Surprisingly, we have now found that in the presence of a deflocculant, liquid non-aqueous detergent compositions can be obtained with an improved degree of clear layer separation and/or improved viscosity and/or an improved tolerance (with respect to viscosity and clear layer separation) to higher volume fractions of solid materials if the particle size distribution of the solids is carefully chosen.

Accordingly the present invention relates to a substantially non-aqueous liquid cleaning product, comprising a non-aqueous organic solvent, a deflocculant and particles of solid material dispersed in the solvent, wherein (a) from 25 to 75% by weight of the solid material has a D(3,2) average particle diameter of less than 10 μm;

(b) from 75 to 25% by weight of the solid material has a D(3,2) average particle diameter of more than 10 μm;

and the D(3,2) average particle diameter of all the solid material is more than 10 μm.

Thus, compositions of the invention comprise two or more fractions of solid materials, at least one of these fractions having a D(3,2) average particle size of less than 10 μm and at least one of these fractions having a D(3,2) average particle size of more than 10 μm.

The first of these fractions preferably has a D(3,2) average particle size in the range of from 2 to 10 μm, more preferred 3 to 9 μm, most preferred 5 to 8 μm. The second of these fractions preferably has a D(3,2) average particle size of from 10 to 100 μm, more preferred from 20 to 80 μm, most preferred from 40 to 60 μm.

For the purpose of the present invention references to average particle diameter refer to the D(3,2) particle size, which is a surface, volume mean diameter calculated as described by M. Alderliesten, Anal. Proc. Vol. 21, May, 1984, 167–172. Hereinafter, any reference to average or mean particle size or diameter refers to the D(3,2) average unless explicitly stated to the contrary.

Preferably the weight ratio of solid material having a particle size of less than 10 μm to solid material having a particle size of more than 10 μm is from 3 : 1 to 1: 3, more preferred 2 : 1 to 1: 2, most preferred from 1.5: 1 to 1: 1.5. In an especially preferred embodiment of the invention the weight ratio is about 1: 1.

The average particle size of the total solid material is preferably from 10 to 100 μm, more preferred 12 to 50 μm, most preferred from 15 to 30 μm.

Preferably the geometric standard deviation $\sigma_g$ of the fractions, as defined in "Small particles statistics", by G. Herdan, M. L. Smith, W. H. Hardwick and P. Connor, second revised edition, 1960, pages 81 and 82, is 3.0, more preferably 2.5, most preferably 2.0, for example between 0 and 1.9.

The particle size can for example be determined by using a Malvern Mastersizer (or a Coulter LS 130).

The particle size distribution found in commercially available particulate solids of the types used in cleaning products is such that the optimum mixing ratio cannot be found by inspection. Therefore the mixing ratios at which the mixing effect on viscosity is best observed are more easily obtained by determining the overall shape of the partial size distribution, i.e. taking into account the average plus the overall width to calculate a reduced maximum packing fraction (i.e. 1-void fraction) for the mixture.

We find these effects are larger in systems which are well deflocculated. In general, smaller particles tend to flocculate more but overall, result in more stable dispersions.

Preferably, compositions according to the present invention produce a sediment on centrifugation, which occupies a smaller volume than that of the parent dispersion at an equal volume fraction of solid material.

The surprising effect of the invention may be contrasted with the behaviour of previously disclosed systems for 'stabilising' dispersions of solids in non-aqueous liquid cleaning products. Colloidal-size silica particles have been used according to the aforementioned GB 1 205 711 and GB 1 270 040 to set-up a suspending network to support larger particles. The same effect is used with the compositions according to the aforementioned U.S. Pat. No. 3,169,930 by using precipitated colloidal size builder particles to form a network to support the larger builder particles. With the aforementioned EP 30 096, the particles of builder and bleach are neither small enough to create a network nor large enough to sediment. Instead they form loose flocs to self-stabilise. However, the addition of a deflocculant to all of these previously known systems destroys the suspending network which has been deliberately created.

BRIEF DESCRIPTION OF THE DRAWINGS

The attached figure shows viscosity measurement (measured in mPa. s at 21S$^{-}$) and clear layer separation measurements based on volume fraction (measured in millimeter for formulations stored for 4 weeks at 37° C.) for various formulations prepared as per Example II.

PRODUCT FORM

All compositions according to the present invention are liquid cleaning products. In the context of this specification, all references to liquids refer to materials which are liquid at 25° C. at atmospheric pressure.

Preferably compositions of the invention have a viscosity of less than 2,500 mPa s at 21 $s^{-1}$, more preferred 100 to 2,000 mPa.s.

They may be formulated in a very wide range of specific forms, according to the intended use. They may be formulated as cleaners for hard surfaces (with or without abrasive) or as agents for warewashing (cleaning of dishes, cutlery etc) either by hand or mechanical means, as well as in the form of specialised cleaning products, such as for surgical apparatus or artificial dentures. They may also be formulated as agents for washing and/or conditioning of fabrics, including compositions for the pre-treatment of fabrics before washing. In order to facilitate stain removal.

Thus, the compositions will contain at least one agent which promotes the cleaning and/or conditioning of the article(s) in question, selected according to the intended application. Usually, this agent will be selected from surfactants, enzymes, bleaches, detergency builders, microbiocides, (for fabrics) fabric softening agents and (in the case of hard surface cleaning) abrasives. Of course in many cases, more than one of these agents will be present, as well as other ingredients commonly used in the relevant product form.

SURFACTANT

Where surfactants are solids, they will usually be dissolved or dispersed in the liquid phase. Where they are liquids, they will usually constitute all or part of the liquid phase. However, in some cases the surfactants may undergo a phase change in the composition.

In general, surfactants for use in the compositions of the invention may be chosen from any of the classes, sub-classes and specific materials described in "Surface Active Agents" Vol. I, by Schwartz & Perry, Interscience 1949 and "Surface Active Agents" Vol. II by Schwartz, Perry & Berch (Interscience 1958), in the current edition of "McCutcheon's Emulsifiers & Detergents" published by the McCutcheon division of Manufacturing Confectioners Company or in "Tensid-Taschenbuch", H. Stache, 2nd Edn., Carl Hanser Verlag, München & Wien, 1981.

In respect of all surfactant materials, but also with reference to all ingredients described herein as examples of components in compositions according to the present invention, unless the context requires otherwise, the term "alkyl" refers to a straight or branched alkyl moiety having from 1 to 30 carbon atoms, whereas lower alkyl refers to a straight or branched alkyl moiety of from 1 to 4 carbon atoms. These definitions apply to alkyl species however incorporated (e.g. as part of an aralkyl species). Alkenyl (olefin) and alkynyl (acetylene) species are to be interpreted likewise (i.e. in terms of configuration and number of carbon atoms) as are equivalent alkylene, alkenylene and alkynylene linkages. For the avoidance of doubt, any reference to lower alkyl or $C_{1-4}$ alkyl (unless the context so forbids) is to be taken specifically as a recitation of each species wherein the alkyl group is (independent of any other alkyl group which may be present in the same molecule) methyl, ethyl, iso-propyl, n-propyl, n-butyl, iso-butyl and t-butyl, and lower (or $C_{1-4}$) alkylene is to be construed likewise.

NON-IONIC SURFACTANTS

Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di- alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants' published European specification EP-A-225,654, especially for use as all or part of the liquid phase. Also preferred are those ethoxylated nonionics which are the condensation products of fatty alcohols with from 9 to 15 carbon atoms condensed with from 3 to 11 moles of ethylene oxide. Examples of these are the condensation products of C11–13 alcohols with (say) 3 or 7 moles of ethylene oxide. These may be used as the sole nonionic surfactants or in combination with those of the described in the last-mentioned European specification, especially as all or part of the liquid phase.

Another class of suitable nonionics comprise the alkyl polysaccharides (Polyglycosides/oligosaccharides) such as described in any of specifications U.S. Pat. Nos. 3,640,998; 3,346,558; U.S. Pat. No. 4,223,129; EP-A-92,355; EP-A-99,183; EP 70,074, '75, '76, ×77; EP 75,994, '95, '96.

Mixtures of different nonionic detergent surfactants may also be used. Mixtures of nonionic detergent surfactants with other detergent surfactants such as anionic, cationic or ampholytic detergent surfactants and soaps may also be used. Preferably the level of nonionic surfactants is from 10 to 90% by weight of the composition, more preferably 20 to 70%, most preferably 35 to 50% by weight.

ANIONIC SURFACTANTS

Examples of suitable anionic detergent surfactants are alkali metal, ammonium or alkylolamine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, and olefin sulphonates prepared by sulphonation of C10–24 alpha-olefins and subsequent neutralization and hydrolysis of the sulphonation reaction product. All ingredients before incorporation will either be liquid, in which case, in the composition they will constitute all or part of the liquid phase, or they will be solids, in which case, in the composition they will either be dispersed in the liquid phase or they will be dissolved therein. Thus as used herein, the term "solids" is to be construed as referring to materials in the solid phase which are added to the composition and are dispersed therein in solid form, those solids which dissolve in the liquid phase and those solids in the liquid phase which solidify (undergo a phase change) in the composition, wherein they are then dispersed.

THE NON-AQUEOUS ORGANIC SOLVENT

As a general rule, the most suitable liquids to choose as the liquid phase are those organic materials having polar molecules. In particular, those comprising a relatively lipophilic part and a relatively hydrophilic part, especially a hydrophilic part rich in electron lone pairs, tend to be well suited. This is completely in accordance with the observation that liquid surfactants, especially polyalkoxylated nonionics, are one preferred class of material for the liquid phase.

Non-surfactants which are suitable for use as the liquid phase include those having the preferred molecular forms referred to above although other kinds may be used, especially if combined with those of the former, more preferred types. In general, the non-surfactant solvents can be used alone or with in combination with liquid surfactants. Non-surfactant solvents which have molecular structures which fall into the former, more preferred category include ethers, polyethers, alkylamines and fatty amines, (especially di- and tri-alkyl- and/or fatty- N-substituted amines), alkyl (or fatty) amides and mono-and di-N-alkyl substituted derivatives thereof, alkyl (or fatty) carboxylic acid lower alkyl esters, ketones, aldehydes, glycols and glycerides. Specific examples include respectively, di-alkyl ethers, polyethylene glycols, alkyl ketones (such as acetone) and glyceryl tri-alkylcarboxylates (such as glyceryl tri-acetate), glycerol, propylene glycol, and sorbitol.

Many light solvents with little or no hydrophilic character are in most systems, unsuitable on their own. Examples of these are lower alcohols, such as ethanol, or higher alcohols, such as dodecanol, as well as alkanes and olefins. However, they can be combined with other liquid materials.

AMOUNT OF LIQUID PHASE

Preferably, the compositions of the invention contain the liquid phase (whether or not comprising liquid surfactant) in an amount of at least 10% by weight of the total composition. The amount of the liquid phase present in the composition may be as high as about 90%, but in most cases the practical amount will lie between 20 and 70% and preferably between 35 and 50% by weight of the composition.

SOLIDS CONTENT

The total solids content may be chosen from within a very wide range, according to the intended use of the final composition, for example from 10 to 90%, usually from 30 to 80% and preferably from 50 to 65% by weight of the final composition. Generally speaking, the beneficial effects of providing two populations of particle sizes in accordance with the principles of the present invention will be more marked, the higher the solids content.

OTHER INGREDIENTS

In addition to the components already discussed, there are very many other ingredients which can be incorporated in liquid cleaning products.

There is a very great range of such other ingredients and these will be chosen according to the intended use of the product.

However, the greatest diversity is found in products for fabrics washing and/or conditioning. Many ingredients intended for that purpose will also find application in products for other applications (e.g. in hard surface cleaners and warewashing liquids).

DETERGENCY BUILDERS

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aluminosilicates-type materials, particularly the alkali-metal salt forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous aluminosilicates. Specific examples include sodium carbonate (with or without calcite seeds), potassium carbonate, sodium and potassium bicarbonates, sodium metasilicate, silicates and zeolites.

Examples of organic builders include the alkali metal, ammonium and substituted ammonium, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates and polyitaconates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/polymaleic acid co-polymers and their salts, such as those sold by BASF under the Sokalan Trade Mark.

Preferably the level of builder materials is from 0 to 75% by weight of the composition, more preferred 5 to 50%, most preferred 10 to 40% It is preferred that alkali metal carbonate builders (if present) will be included in amounts of from about 10% to about 20% by weight.

THE DEFLOCCULANT

The compositions of the invention also comprise a deflocculant material. In principle, any material may be used as a deflocculant provided it fulfils the deflocculation test described in the aforementioned European Patent Specification EP-A-266 199. The capability of a substance to act as a deflocculant will partly depend on the solids/liquid phase combination. Although also salts of the following materials can be used, acids are especially preferred. Some typical examples of deflocculants include the alkanoic acids such as acetic, propionic and stearic and their halogenated counterparts such as trichloracetic and trifluoracetic as well as the alkyl (e.g. methane) sulphonic acids and aralkyl (e.g. paratoluene) sulphonic acids. Phosphoric acid esters may also be used.

Examples of suitable inorganic mineral acids and their salts are hydrochloric, carbonic, sulphurous, sulphuric and phosphoric acids; potassium monohydrogen sulphate, sodium monohydrogen sulphate, potassium monohydrogen phosphate, potassium dihydrogen phosphate, sodium monohydrogen phosphate, potassium dihydrogen pyrophosphate, tetrasodium monohydrogen triphosphate.

Other organic acids, or salts thereof, may also be used as deflocculants, for example formic, lactic, amino acetic, benzoic, salicylic, phthalic, nicotinic, ascorbic, ethylenediamine tetraacetic, and aminophosphonic acids, as well as longer chain fatty carboxylates and triglycerides, such as oleic, stearic, lauric acid and the like. Peracids such as percarboxylic and persulphonic acids may also be used.

The class of acid deflocculants further extends to the Lewis acids, including the anhydrides of inorganic and organic acids. Examples of these are acetic anhydride, maleic anhydride, phthalic anhydride and succinic anhydride, sulphur-trioxide, diphosphorous pentoxide, boron trifluoride, antimony pentachloride.

"Fatty" anions are very suitable deflocculants, and a particularly preferred class of deflocculants comprises anionic surfactants. Although anionics which are salts of alkali or other metals may be used, particularly preferred are the free acid forms of these surfactants (wherein the metal cation is replaced by an H+ cation, i.e. proton). These anionic surfactants include all those classes, subclasses and specific forms described in the aforementioned general references on surfactants, viz, Schwartz & Perry, Schwartz Perry and Berch, McCutcheon's, Tensid-Taschenbuch; and the free acid forms thereof. Many anionic surfactants have already been described hereinbefore. In the role of deflocculants, salts can be used, but the free acid forms of these are generally preferred.

In particular, some preferred sub-classes and examples are the C10–22 fatty acids and dimers thereof, the C8–18 alkylbenzene sulphonic acids, the C10–C18 alkyl- or alkylether sulphuric acid monoesters, the C12–C18 paraffin sulphonic acids and disulphonic acids, the fatty acid sulphonic acids, the benzene-, toluene-, xylene- and cumene sulphonic acids and salts thereof and so on. Particularly are the linear C12-C18 alkylbenzene sulphonic acids and salts.

As well as anionic surfactants, zwitterionic-types can also be used as deflocculants. These may be any described in the aforementioned general surfactant references. One example is lecithin.

The level of the deflocculant material in the composition can be optimised by the means described in the aforementioned EP-A-266199, but in very many cases is at least 0.01%, usually 0.1% and preferably at least 0.3% by weight, and may be as high as 15% by weight. For most practical purposes, the amount ranges from 0.5 to 12%, preferably from 1 to 5% by weight, based on the final composition.

THE BLEACH SYSTEM

Bleaches include the halogen, particularly chlorine bleaches such as are provided in the form of alkali metal hypohalites, e.g. hypochlorites. In the application of fabrics washing, the oxygen bleaches are preferred, for example in the form of an inorganic persalt, preferably with a bleach precursor, or as a peroxy acid compound. In the case of the inorganic persalt bleaches, the activator makes the bleaching more effective at lower temperatures, i.e. in the range from ambient temperature to about 60° C., so that such bleach systems are commonly known as low-temperature bleach systems and are well-known in the art. The inorganic persalt such as sodium perborate, both the monohydrate and the tetrahydrate, acts to release active oxygen in solution, and the activator is usually an organic compound having one or more reactive acyl residues, which cause the formation of peracids, the latter providing for a more effective bleaching action at lower temperatures than the peroxybleach compound alone.

The ratio by weight of the peroxybleach compound to the activator is preferably from about 20:1 to about 1:1, preferably from about 10:1 to about 2:1, most preferably 5:1 to 3.5:1. Whilst the amount of the bleach system, i.e. peroxybleach compound and activator, may be varied between about 5% and about 35% by weight of the total liquid, it is preferred to use from about 6% to about 30% of the ingredients forming the bleach system. Thus, the preferred level of the peroxybleach compound in the composition is between about 5.5% and about 27% by weight, while the preferred level of the activator is between about 0.5% and about 14%, most preferably between about 1% and about 5% by weight.

Typical examples of the suitable peroxybleach compounds are alkalimetal perborates, both tetrahydrates and monohydrates, alkali metal percarbonates, persilicates and perphosphates, of which sodium perborate and sodium percarbonate are preferred.

Peracids per se which are stable in the non-aqueous liquid phase may also be used.

It is particularly preferred to include in the compositions, a stabiliser for the bleach or bleach system, for example ethylene diamine tetramethylene phosphonate and diethylene triamine pentamethylene phosphonate or other appropriate organic phosphonate or salt thereof, such as the Dequest range hereinbefore described. These stabilisers can be used in acid or salt form, such as the calcium, magnesium, zinc or aluminium salt form. The stabiliser may be present at a level of up to about 1% by weight, preferably between about 0.1% and about 0.5% by weight.

Preferred activator materials are TAED and glycerol triacetate. The applicants have also found that liquid bleach activator, such as glycerol triacetate and ethylidene heptanoate acetate, isopropenyl acetate and the like, also function suitably as a material for the liquid phase, thus obviating or reducing any need of additional relatively volatile solvents, such as the lower alkanols, paraffins, glycols and glycolethers and the like, e.g. for viscosity control.

MISCELLANEOUS OTHER INGREDIENTS

Other ingredients comprise those remaining ingredients which may be used in liquid cleaning products, such as fabric conditioning agents, metal oxides such as magnesium oxide, dispersants such as hydrophobically modified silica materials, enzymes, perfumes (including deoperfumes), microbiocides, colouring agents, fluorescers, soil-suspending agents (anti-redeposition agents), corrosion inhibitors, enzyme stabilising agents, and lather depressants.

Amongst the fabric conditioning agents which may be used, either in fabric washing liquids or in rinse conditioners, are fabric softening materials such as fabric softening clays, quaternary ammonium salts, imidazolinium salts, fatty amines and cellulases.

Enzymes which can be used in liquids according to the present invention include proteolytic enzymes, amylolytic enzymes and lipolytic enzymes (lipases). Various types of proteolytic enzymes and amylolytic enzymes are known in the art and are commercially available. They may be incorporated as "prills" or "marumes", suspensions etc.

The fluorescent agents which can be used in the liquid cleaning products according to the invention are well known and many such fluorescent agents are available commercially. Usually, these fluorescent agents are supplied and used in the form of their alkali metal salts, for example, the sodium salts. The total amount of the fluorescent agent or agents used in a detergent composition is generally from 0.02–2% by weight.

When it is desired to include anti-redeposition agents in the liquid cleaning products, the amount thereof is normally from about 0.1% to about 5% by weight, preferably from about 0.2% to about 2.5% by weight of the total liquid composition. Preferred anti-redeposition agents include carboxy derivatives of sugars and celluloses, e.g. sodium carboxymethyl cellulose, anionic poly-electrolytes, especially polymeric aliphatic carboxylates, or organic phosphonates. Also possible are anti-ashing materials based upon polymeric vinyl sulphates and sulphonates and their copolymers.

AMOUNT OF WATER

The compositions are substantially non-aqueous, i.e. they contain little or no free water, preferably no more than 10%, for example 5%, preferably less than 3%, especially less than 1% by weight of the total composition. It has been found that the higher the water content, the more likely it is for the viscosity to be too high, or even for setting to occur.

USE

Composition in accordance with the present invention may be used for several detergency purposes, for example the cleaning of surfaces and the washing of fabrics. For the washing of fabrics, preferably an aqueous liquor containing 0.05 to 10 %, more preferably 0.1 to 2%, of the non-aqueous detergent composition of the invention is used.

PROCESSING

During manufacture, it is preferred that all raw materials should be dry and (in the case of hydratable salts) in a low hydration state, e.g. anhydrous phosphate builder, sodium perborate monohydrate and dry calcite abrasive, where these are employed in the composition.

During the milling procedure(s), the energy input results in a temperature rise in the product and the liberation of air entrapped in or between the particles of the solid ingredients. It is therefore highly desirable to mix any heat sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components, such as TAED, or volatile solvent components which may be desirable in the final composition. However, it is especially preferred that volatile material be introduced after any step of de-aeration. Suitable equipment for cooling (e.g. heat exchangers) and de-aeration will be known to those skilled in the art.

It follows that all equipment used in this process should preferably be completely dry, special care being taken after any cleaning operations. The same is true for subsequent storage and packing equipment.

In the broadest aspect the invention provides a process for preparing a substantially non-aqueous liquid cleaning product composition, comprising a non-aqueous organic solvent, a deflocculant and particles of solid material dispersed in the solvent, characterised in that the process comprises the mixing of solid material with a D(3,2) average particle diameter of more than 10μm and solid material with a D(3,2) average particle diameter of less than 10μm and adding the organic solvent and/or the deflocculant before, during or after the mixing.

An advantage of the process of the invention is that by partially milling to small particles, much less energy will be required as compared t conventional processes, such as ball-milling the total solid content to small particles.

In a preferred process, at least two predispersions are made of solid material in a liquid phase, whereafter each of the two predispersions is separately milled to the desired average particle size. Preferably the first of these predispersions is milled in a ball-mill to an average particle size of the solid phase of less than 10 μm and the second of the predispersions is milled in a colloid mill to an average particle size of the solid phase of more than 10 μm. The first predispersion may be milled first in a colloid mill before ball milling.

It is preferred to subject the hardest particles, e.g. perborates or metasilicates to preferential milling since most other components are easily reduced to the required size by colloid milling alone.

To achieve the two populations (distributions) it is possible to subject all of the composition to one phase of (colloid) milling and to recycle continuously, a proportion of the milled product to be milled again.

For preparing the final product the predispersions are admixed in the desired ratio. Optionally there may be other predispersions than the two described above and/or solid materials may be mixed into the final product in dry solid form. Therefore, in the final product there may be three or more population distributions with respect to particle diameter, although it is possible that with certain distributions, admixture of three or more populations will result in a composition which when analyzed, will show only two.

Preferably, however the final product is prepared by the mixing of two predispersion and optionally in addition thereto one or more particulate solid materials and/or minor ingredients, the first of the predispersion having an average particle size of the dispersed phase of less than 10 μm, the second having an average particle size of more than 10 μm.

The invention will further be illustrated by the following examples.

Example 1

A first predispersion was made by mixing the ingredients in the listed order. The predispersion was ball-milled in a Dispermat mill to an average particle size of 0.82 μm (example A) or dry-milled in an Alpine mill to an average particle size of 5.8 μm (example B).

A second predispersion was made by mixing the ingredients in the listed order. The predispersion remained unmilled, the average particle size of the unmilled particles is 62 μm (example C).

| Ingredient % wt | predispersion I A | predispersion I B | predispersion II C |
|---|---|---|---|
| liquid phase (1) | 55 | 51 | 47.2 |
| perborate mono | 45 | 49 | 52.8 |
| viscosity (2) | 2,000 | 2,260 | 1,950 |

(1) the liquid phase consisted of:

| | Examples: A | B | C |
|---|---|---|---|
| Nonionic (3) | 50.5 | 46.5 | 42.7 |
| LAS acid | 4.5 | 4.5 | 4.5 |

(2) the viscosity was measured in mPa · s at 21 $s^{-1}$ (3) Narrow Range Ethoxylate Novel 1022-6.2 ex Vista.

The predispersions were mixed in various proportions and the viscosity of the resulting mixture was measured. The following results were obtained:

| dispersion I example A or B wt % | dispersion II example C wt % | viscosity of mixture A–C | viscosity of mixture B–C |
|---|---|---|---|
| 100 | 0 | 2,000 | 2,260 |
| 80 | 20 | 1,850 | 1,680 |
| 60 | 40 | 1,750 | 1,460 |
| 50 | 50 | 1,700 | 1,410 |
| 40 | 60 | 1,700 | 1,460 |
| 20 | 80 | 1,750 | 1,610 |
| 0 | 100 | 1,950 | 1,950 |

These results indicate that surprisingly a significant viscosity reduction can be obtained by combining two fractions, one having an average particle size of less than 10 μm and one having a weight average particle size of more than 10 μm.

Example II

Several dispersions of perborate monohydrate in liquid phase, that consisted of Vista Novel 1022-6.2 nonionic and LAS acid, were prepared as follows. The amount of LAS in all dispersions was 4.5% by weight of the total composition.

A first set of dispersions (A) was prepared by mixing unmilled perborate monohydrate having an average particle size of 62 μm into the liquid, and adjusting the viscosity by varying the amount of nonionic. The addition of nonionic resulted in the individual dispersions of A having different volume fractions of solids of 0.28, 0.29 and 0.30.

A second set of dispersions (B) was prepared as above, except that dry-milled perborate monohydrate having an average particle size of 5.8 μm was used.

A third set of dispersions (C) was prepared by mixing a predispersion of unmilled perborate monohydrate in liquid with an equal amount of a predispersion of dry-milled perborate in liquid, followed by the addition of nonionic for adjusting the viscosity. Again, the addition of nonionic resulted in the individual dispersions of C having different volume fractions of solids of 0.28, 0.29 and 0.30.

For each of the formulations the viscosity in mPa.s at 21 $s^{-1}$ was measured. Subsequently the formulations were stored for 4 weeks at 37° C. and the clear layer separation was measured in millimeters from the bottom of the miniscus to the top of the sediment layer. The attached figure shows the results of the experiments. On the left verticle axis the viscosity is indicated in mPa.s at 21 $s^{-1}$; on the horizontal axis the volume fraction of the solid is indicated; and on the right verticle axis the clear layer separation is indicated in millimeters.

Lines 1, 2 and 3 represent the clear layer separation of dispersions A, B and C respectively and lines 4, 5 and 6 represent the viscosity of dispersions B, A and C respectively.

The results showed that for each type of dispersion, a reduction in clear layer separation can generally only be obtained at the expense of a higher viscosity.

Surprisingly, it was observed that when dispersions of the same volume fraction are compared, the viscosities of dispersions C were lower (line 6) than the viscosities of dispersions B and A (lines 4 and 5). Further, surprisingly it was observed that when the dispersions of the same volume fraction were compared, the clear layer separation of dispersions C was lower (line 3) than the corresponding dispersions A and B (lines 1 and 2). Surprisingly, it was observed that if mixtures of two fractions are used this results in a reduction of clear layer formation while the viscosity remains the same, or in a reduction of viscosity when the clear layer formation remains the same.

We claim:

1. A substantially non-aqueous liquid cleaning product composition, comprising from 10 to 90% by weight of a non-aqueous organic solvent, from 0.01 to 15% by weight of a deflocculant selected from the group consisting of inorganic mineral acids and their salts, peracids, Lewis acids, anionic surfactants, zwitterionic surfactants and mixtures thereof, and from 30 to 90% by weight of particles of solid material dispersed in the solvent, selected from the group consisting of inorganic persalt bleaches wherein the weight ratio of solid material having a D(3,2) average particle diameter of less than 10 μm to solid material having a D(3,2) average particle diameter of 40 to 60 μm is from 2:1 to 1:3; and the D(3,2) average particle size of the solid material is more than 10 μm the composition having a viscosity of less than about 1,750 mPas at $s^{-1}$.

2. A composition according to claim 1, wherein said first fraction has a D(3,2) average particle diameter of from 2 μm to 10 μm.

* * * * *